US007762563B2

(12) United States Patent
Chuang

(10) Patent No.: US 7,762,563 B2
(45) Date of Patent: Jul. 27, 2010

(54) ROLLER SKATE

(76) Inventor: Tony Chuang, No. 360, Daguan Rd., Nantun District, Taichung (TW)

( * ) Notice: Subject to any disclaimer, the term of this patent is extended or adjusted under 35 U.S.C. 154(b) by 215 days.

(21) Appl. No.: 12/165,223

(22) Filed: Jun. 30, 2008

(65) Prior Publication Data

US 2009/0322044 A1 Dec. 31, 2009

(51) Int. Cl.
*A63C 17/00* (2006.01)

(52) U.S. Cl. ..... 280/11.19; 280/11.204; 280/11.25

(58) Field of Classification Search ..... 280/11.19, 280/11.204, 11.212, 11.214, 11.215, 11.233, 280/11.25
See application file for complete search history.

(56) References Cited

U.S. PATENT DOCUMENTS 1,497,224 A * 6/1924 Ormiston ..... 280/11.214
4,275,895 A * 6/1981 Edwards ..... 280/11.214
6,089,579 A * 7/2000 Pellegrini et al. ..... 280/11.214
6,536,783 B2 * 3/2003 Gorza et al. ..... 280/11.204
2006/0038364 A1 * 2/2006 Hsu ..... 280/11.233

* cited by examiner

*Primary Examiner*—Paul N Dickson
*Assistant Examiner*—John D Walters
(74) *Attorney, Agent, or Firm*—patenttm.us

(57) ABSTRACT

A roller skate has a body, a brake and a sole adjusting device. The body has a front bracket, a rear bracket and a holding frame. The brake is connected to the body and has an operating device and a braking device. The operating device is connected pivotally to the body and has a mounting frame, a connecting frame and a pressing arm. The braking device is connected to the rear brake below the pressing arm and has a clamping frame and an abutting frame. The clamping frame is connected to the body. The abutting frame is connected to the rear bracket above the clamping frame. The sole adjusting frame is connected to the body and has a baseplate, a front adjusting panel and two rear adjusting panels. The baseplate is mounted on body. The adjusting panels are mounted movably on the baseplate.

11 Claims, 9 Drawing Sheets

ROLLER SKATE

BACKGROUND OF THE INVENTION

1. Field of the Invention

The present invention relates to a roller skate, and more particularly to a roller skate that can be used safely.

2. Description of Related Art

Conventional roller skates have rollers or blades to increase the speed and versatility of the roller skates.

With reference to FIG. 9, a conventional roller skate has a body (50), a front roller (51), a rear roller (52) and a brake (53). The body (50) has a front end, a rear end, a bottom and a middle. The front roller (51) is rotatably mounted on the bottom of the body (50) near the front end. The rear roller (52) is rotatably mounted on the bottom of the body (50) near the rear end.

The brake (53) is connected pivotally to the middle of the body (50) above the rear roller (52) and has a mounting frame (531), a holding frame (532) and a brake pad (534). The mounting frame (531) is connected pivotally to the middle of the body (50) and extends toward the rear roller (52) and has a rear side. The holding frame (532) is connected securely to the rear side of the mounting frame (531) and has a front side, a rear side, an upper end, a lower end and a belt (533). The belt (533) is connected to the front side of the holding frame (532) to hold a leg of a user with the holding frame (532). The brake pad (534) is triangular, is mounted immovably on the rear side of the holding frame (532) and extends toward the rear roller (52).

When a user wants to stop the conventional roller skate, the user has to move the leg backward to pivot the mounting frame (531) and the holding frame (532) relative to the body (50). The brake slice (534) on the rear side of the holding frame (532) then rubs against the rear roller (52) to slow down and stop the conventional roller skate.

However, the conventional roller skate has the following shortcomings.

1. The conventional roller skate can be stopped by the brake pad (534) rubbing directly against the rear roller (52), but this may make the conventional roller skate stopping suddenly and cause the user falling down and getting hurt.

2. The brake slice (534) will wear downs quickly due to the direct contact of the brake pad (534) against the rear roller (52) and cannot provide an enough braking effect to the conventional roller skate.

3. The brake pad (534) is mounted immovably on the rear side of the holding frame (532), and so the brake pad (534) cannot be adjusted in height to fit with different needs and is inconvenient in use.

The present invention provides a roller skate to mitigate or obviate the aforementioned problems.

SUMMARY OF THE INVENTION

The main objective of the present invention is to provide a roller skate that can be used in safety.

The roller skate in accordance with the present invention has a body, a brake and a sole adjusting device. The body has a front bracket, a rear bracket and a holding frame. The brake is connected to the body and has an operating device and a braking device. The operating device is connected pivotally to the body and has a mounting frame, a connecting frame and a pressing arm. The mounting frame is connected pivotally to the holding frame. The connecting frame is connected detachably to the mounting frame. The pressing arm is connected to the connecting frame. The braking device is connected to the rear bracket below the pressing arm and has a clamping frame and an abutting frame. The clamping frame is connected to the body between the rear bracket and the rear roller. The abutting frame is connected to the rear bracket above the clamping frame. The sole adjusting frame is connected to the body and has a baseplate, a front adjusting panel and two rear adjusting panels. The baseplate is mounted on body. The adjusting panels are mounted movably on the baseplate Other objectives, advantages and novel features of the invention will become more apparent from the following detailed description when taken in conjunction with the accompanying drawings.

DETAILED DESCRIPTION OF THE PREFERRED EMBODIMENT

Figure 1:
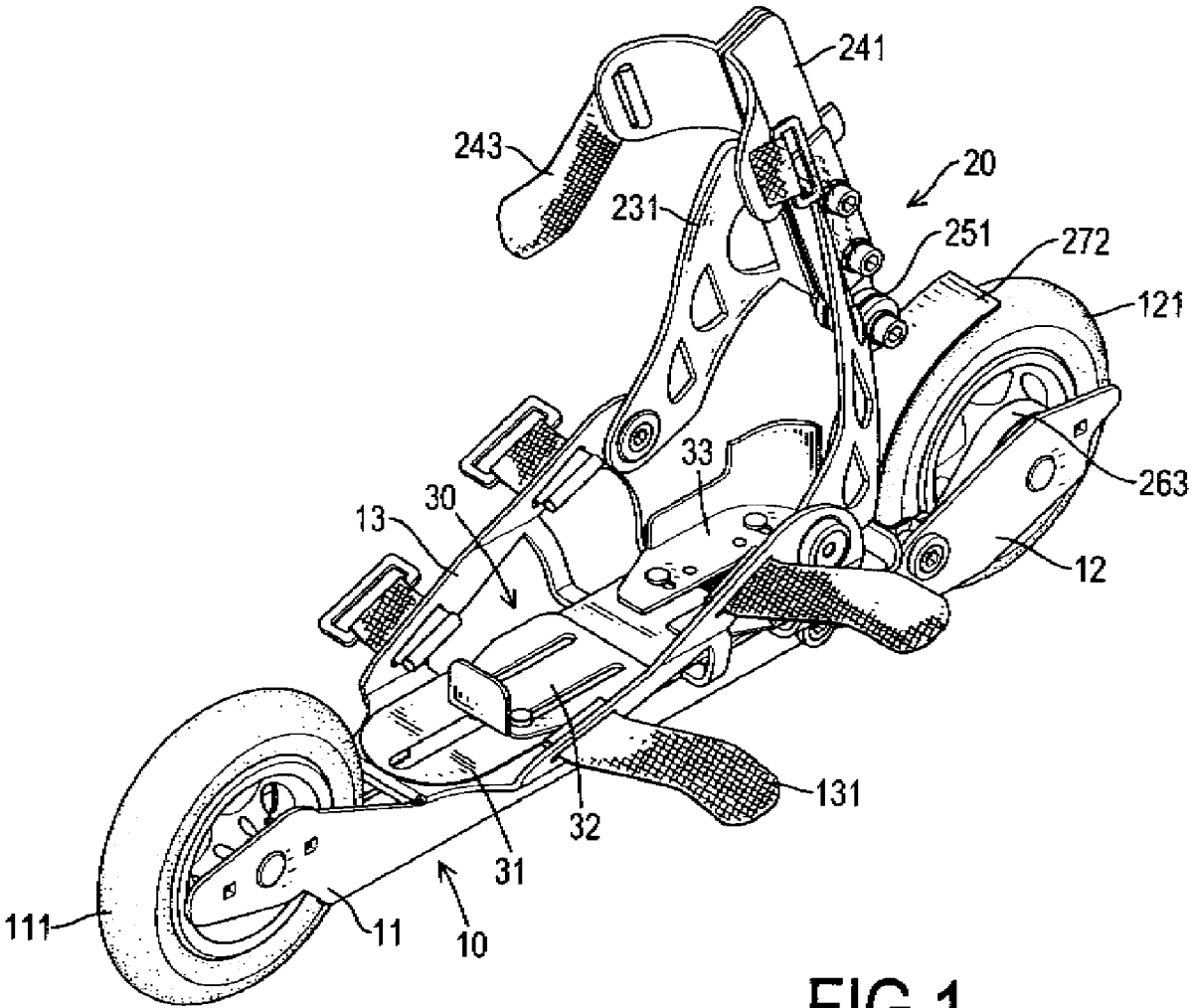
FIG. 1 is a perspective view of a roller skate in accordance with the present invention.
Figure 2:
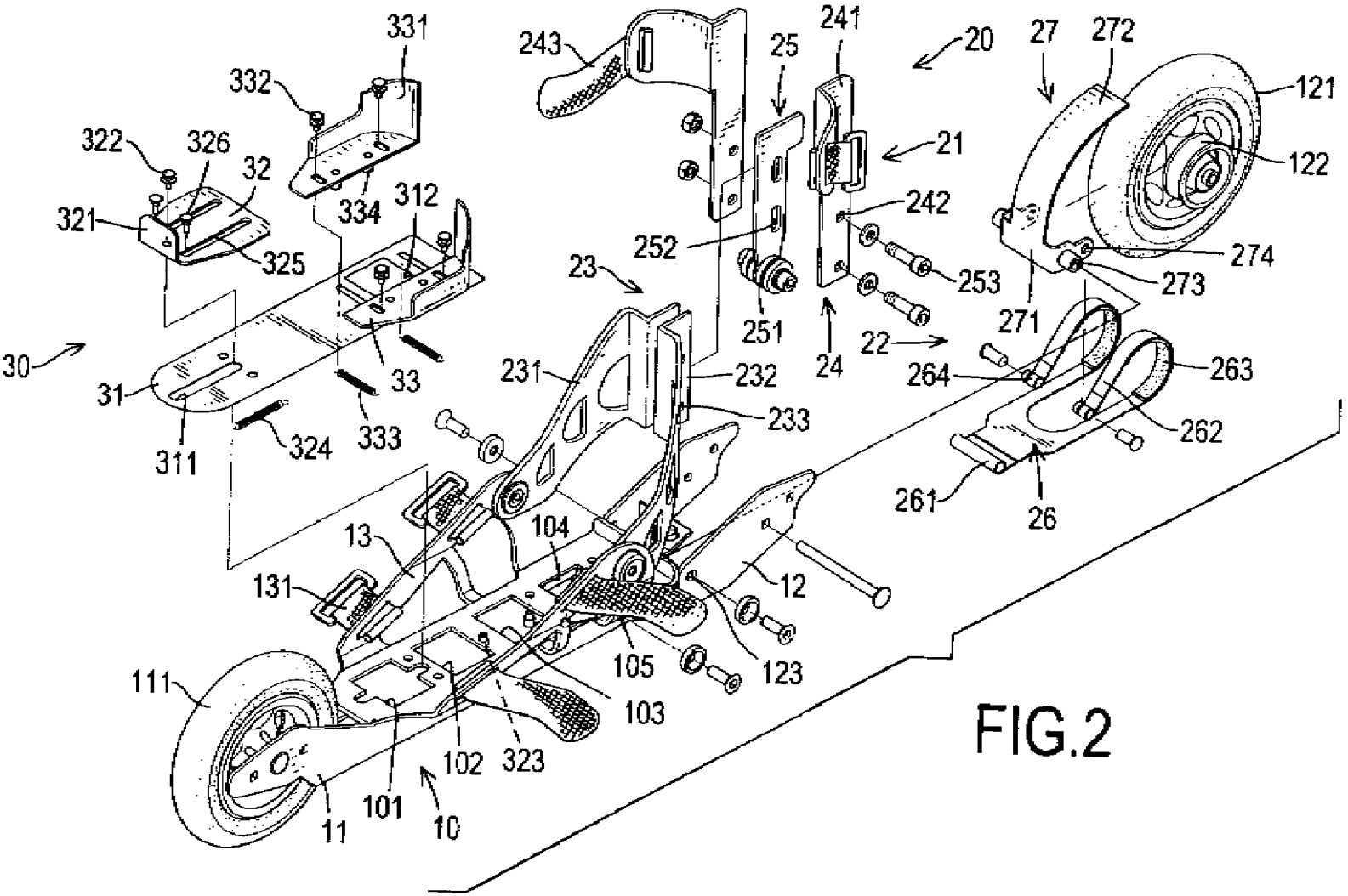
FIG. 2 is an exploded perspective view of the roller skate in FIG. 1.
Figure 3:
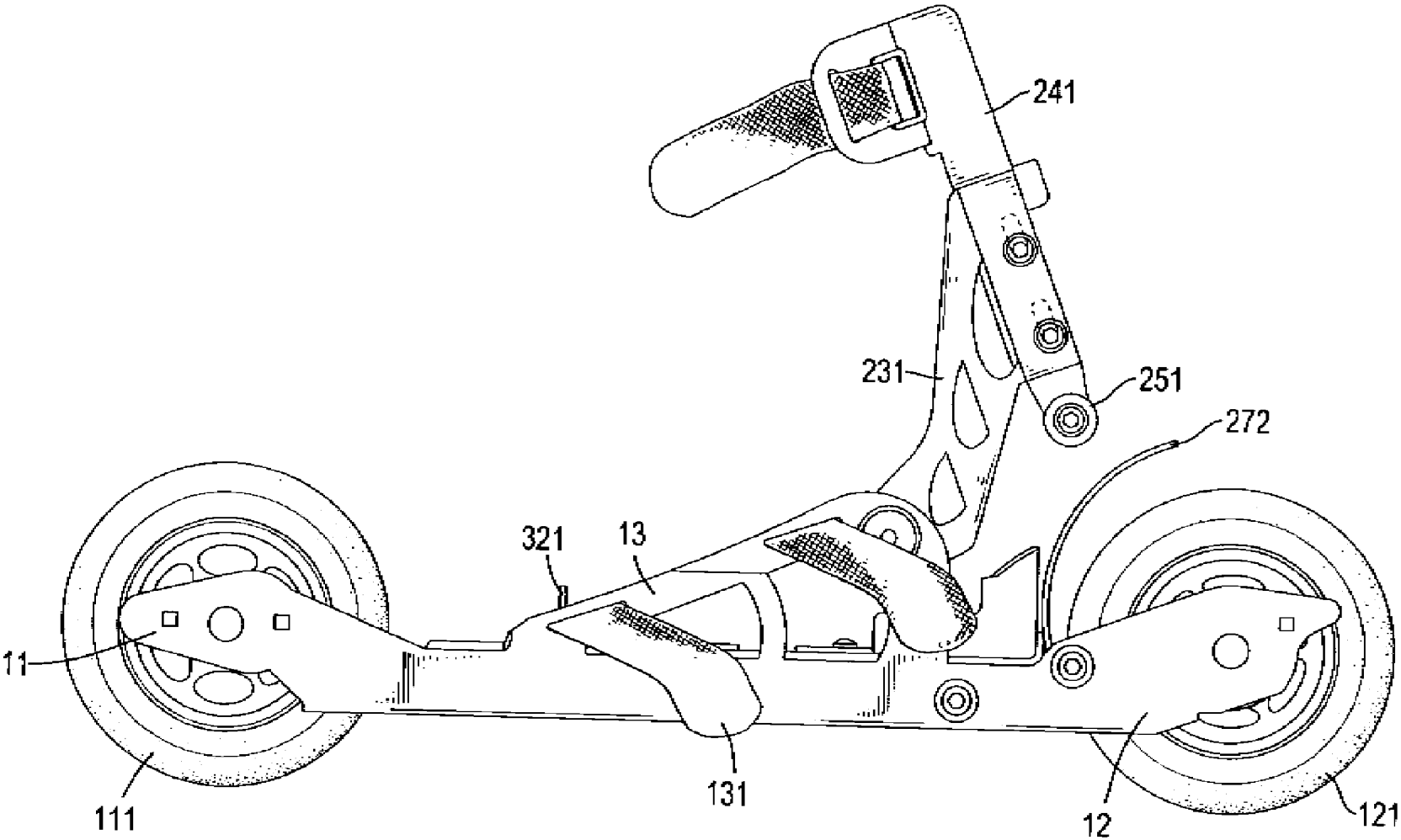
FIG. 3 is a side view of the roller skate in FIG. 1.

With reference to FIGS. 1 to 4, a roller skate in accordance with the present invention has a body (10), a brake (20) and a sole adjusting device (30).

The body (10) has a front end, a rear end, two side edges, a top surface, a bottom surface, a front bracket (11), a rear bracket (12), two mounting holes (105), two holding frames (13) and multiple guiding holes (101, 102, 103, 104).

The front bracket (11) may be U-shaped, is mounted on the front end of the body (10) and has a front end and a front roller (111). The front roller (111) is mounted rotatably in the front end of the front bracket (11).

The rear bracket (12) may be U-shaped, is mounted on the rear end of the body (10) and has a rear end, a rear roller (121) and two connecting holes (123). The rear roller (121) is mounted rotatably in the rear end of the rear bracket (12) and has two sidewalls, an external surface and two annular grooves (122). The annular grooves (122) are respectively formed around the sidewalls of the rear roller (121). The connecting holes (123) are formed transversally through the rear bracket (12) near the rear end of the body (10).

The mounting holes (105) are formed through the body (10) near the rear bracket (12).

The holding frames (13) may be triangular, are mounted respectively on the side edges of the body (10) between the brackets (11, 12) and each has a rear end. Multiple sole belts (131) are connected to the holding frames (13) to hold the sole of a user with the roller skate.

The guiding holes (101, 102, 103, 104) are formed through the top surface of the body (10) between the brackets (11, 12) and the holding frame (13) in a line and include a first guiding hole (101), a second guiding hole (102), a third guiding hole (103) and a fourth guiding hole (104) from the front end to the rear end of the body (10).

The brake (20) is connected to the body (10) and has an operating device (21) and a braking device (22).

The operating device (21) is connected pivotally to the body (10) and has a mounting frame (23), a connecting frame (24) and a pressing arm (25).

The mounting frame (23) is connected pivotally to the holding frames (13) of the body (10) and has two extending arms (231). Each extending arm (231) is connected pivotally to the rear end of one of the holding frames (13) and has a lower end, an upper end, a mounting tab (232) and multiple through holes (233). The lower ends of the extending arms (231) are respectively connected pivotally to the rear ends of the holding frames (13). The mounting tabs (232) are respectively formed on the upper ends of the extending arms (231) above the rear roller (121) of the rear bracket (12) and are parallel with each other. The through holes (233) are formed through the mounting tabs (232).

The connecting frame (24) is connected detachably to the mounting frame (23) and has two connecting beams (241). The connecting beams (241) are connected to the mounting frame (23) between the mounting tabs (232) and each connecting beam (241) has a top end, multiple circular holes (242) and a leg belt (243). The circular holes (242) are formed through the connecting beams (241) and align with the through holes (233) in the mounting tabs (232). The leg belts (243) are respectively connected to the top ends of the connecting beams (241) to hold the leg of a user with the connecting frame (24) of the brake (20).

The pressing arm (25) is connected to the connecting frame (24) between the connecting beams (241) and has a bottom end, a pressing axle (251), multiple elongated holes (252) and multiple fasteners (253). The pressing axle (251) is transversally mounted on the bottom of the pressing element (25) above the rear roller (121) of the rear bracket (12). The elongated holes (252) are formed through the pressing arm (25) and align with the through holes (233) of the mounting frame (23) and the circular holes (242) of the connecting frame (24). The fasteners (253) extend through the through holes (233), the circular holes (242) and the elongated holes (253) to connect the pressing arm (25) with the connecting frame (24) and the mounting frame (23).

The braking device (22) is connected to the rear bracket (12) of the body (10) below the pressing arm (25) of the operating device (21) and has a clamping frame (26) and an abutting frame (27).

The clamping frame (26) is connected to the body (10) between the rear bracket (12) and the rear roller (121) and has a front end, a rear end, a mounting shaft (261), two clamping panels (262), two brake pads (263) and two connecting rods (264). The mounting shaft (261) is transversally formed on the front end of the clamping frame (26) and is mounted in the mounting holes (105) of the body (10). The clamping panels (262) are defined in the rear end of the clamping frame (26) and are bent forward around the annular grooves (122) of the rear roller (121) and each clamping panel (262) has an internal surface and a free end. The brake pads (263) are respectively mounted on the internal surfaces of the clamping panels (262) around the annular grooves (122) of the rear roller (121). The connecting rods (264) are respectively formed on the free ends of the clamping panels (262).

The abutting frame (27) is connected to the rear bracket (12) of the body (10) above the clamping frame (26) and has a bottom end, a linking mount (271) and an abutting panel (272). The linking mount (271) may be U-shaped, is defined in the bottom end of the abutting frame (27) and pivotally connected to the rear bracket (12) and the clamping frame (26) and has two linking holes (273) and two rod holes (274). The linking holes (273) are formed through the linking mount (271) and align with the connecting holes (123) of the rear bracket (12), such that the abutting frame (27) is connected pivotally to the rear bracket (12) with pivots mounting through the linking holes (273) and the connecting holes (123). The rod holes (274) are formed through the linking mount (271) and are respectively mounted around the connecting rods (264) to connect the clamping frame (26) with the abutting frame (27). The abutting panel (272) is formed with the linking frame (271) between the linking holes (273) and the rod holes (274), is curved backward above the rear roller (121) of the rear bracket (12) and has an internal surface. The internal surface of the abutting panel (272) faces to the external surface of the rear roller (121).

Figure 7:
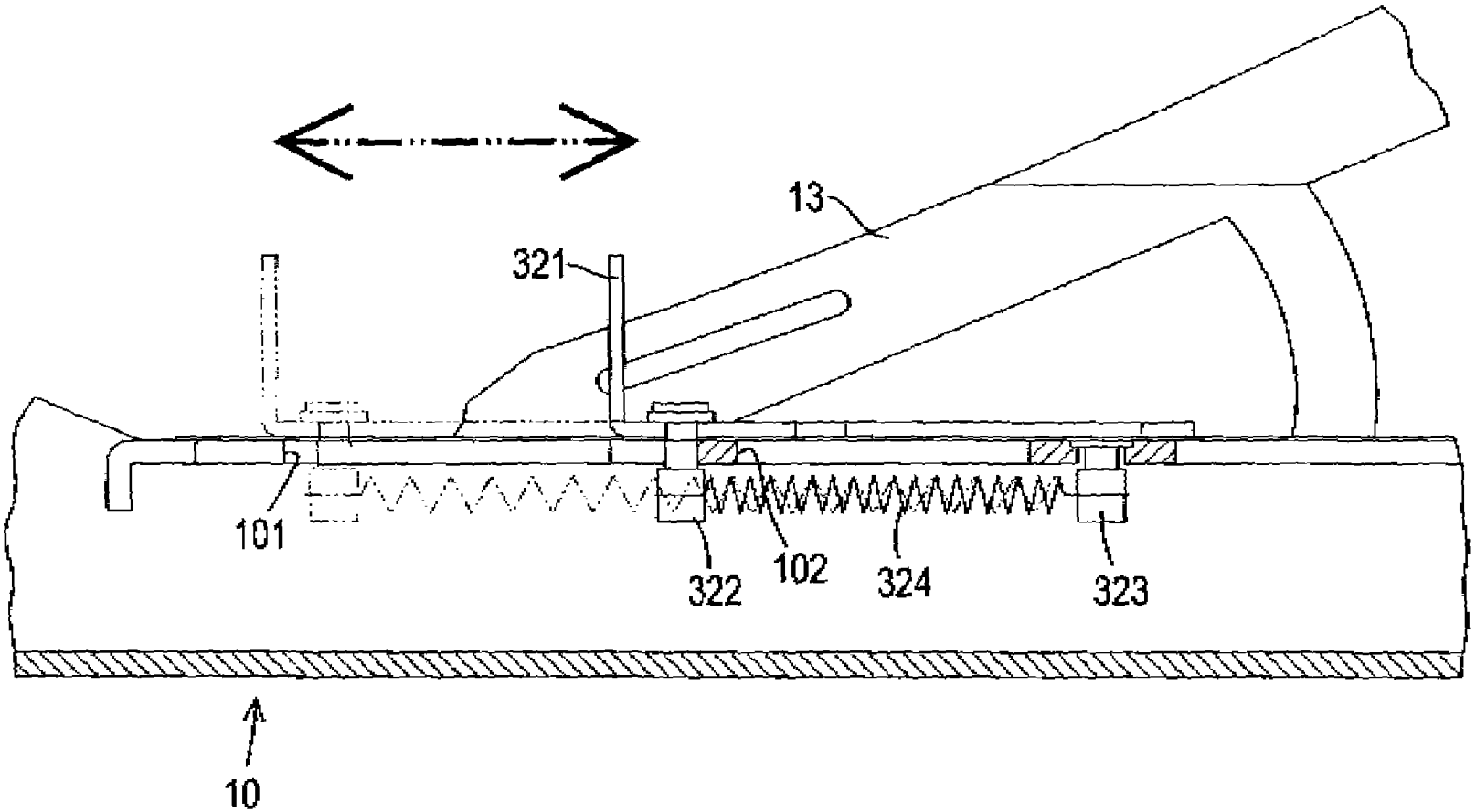
FIG. 7 is an enlarged operational side view in partial section of the roller skate in FIG. 1.
Figure 8:
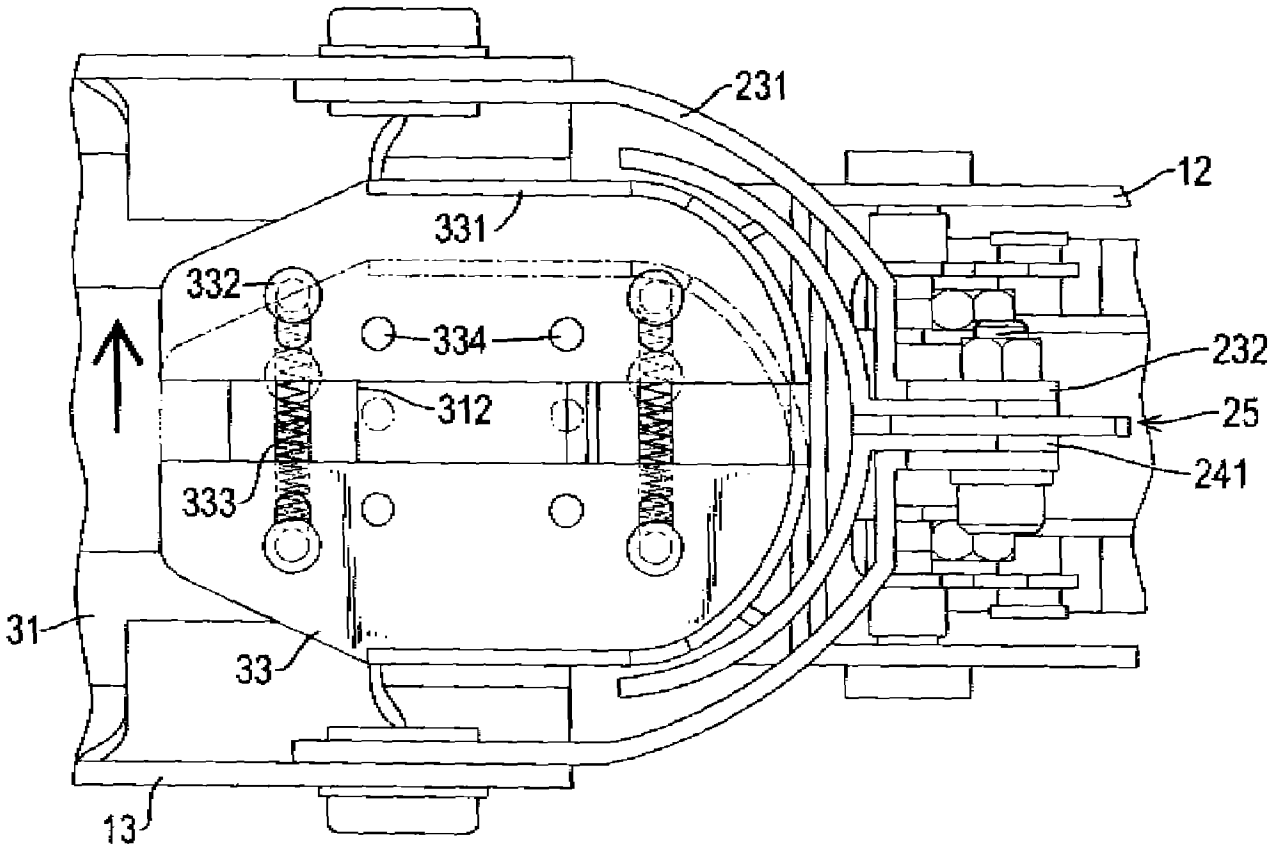
FIG. 8 is an enlarged operational top view in partial section of the roller skate in FIG. 1.
Figure 9:
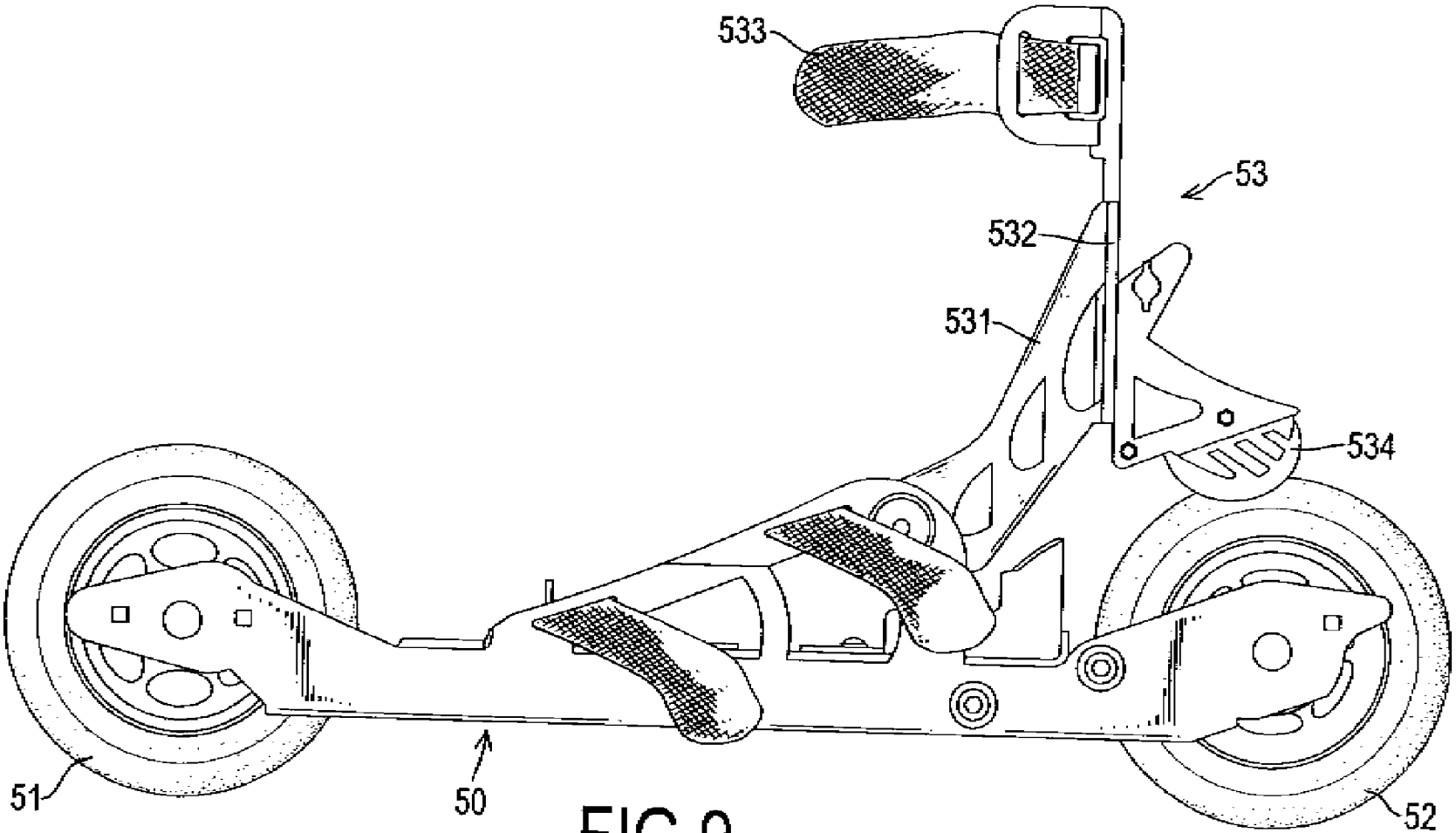
FIG.9 PRIOR ART
FIG. 9 is a side view of a roller skate in accordance with the prior art.

With further reference to FIGS. 7 and 8, the sole adjusting frame (30) is connected to the body (10) and has a baseplate (31), a front adjusting panel (32) and two rear adjusting panels (33).

The baseplate (31) is mounted securely on the top surface of the body (10) over the guiding holes (101, 102, 103, 104) and has a top surface, a front end, a rear end, a front guiding slot (311) and a rear guiding hole (312). The front guiding slot (311) is formed longitudinally through the baseplate (31) near the front end and communicates with the first guiding hole (101) of the body (10). The rear guiding hole (312) is formed transversally through the baseplate (31) near the rear end and communicates with the third guiding hole (103) and the fourth guiding hole (104) of the body (10).

The front adjusting panel (32) is mounted movably on the top surface of the baseplate (31) near the front end and has a front end, a front retaining board (321), a front mounting bolt (322), a mounting post (323), a first spring (324), two front guideways (325) and two front guiding rods (326). The front retaining board (321) is formed on and protrudes from the front end of the front adjusting panel (32) to abut toes of a user. The front mounting bolt (322) is mounted securely in the front adjusting panel (32) near the front retaining board (321) and extends into the front guiding slot (311) of the baseplate (31) and the first guiding hole (101) of the body (10). The mounting post (323) is mounted securely on the bottom surface of the body (10) between the second and third guiding holes (102, 103). The first spring (324) is connected to the front mounting bolt (322) and the mounting post (323) below the body (10). The front guideways (325) are formed through the front adjusting panel (32) and parallel to the front guiding slot (311) of the baseplate (31). The front guiding rods (326) are mounted on the top surface of the body (10) between the first and second guiding holes (101, 102), extend through the baseplate (31) and are respectively extended into the front guideways (325) of the front adjusting panel (322) to make the front adjusting panel (32) moving smoothly relative to the baseplate (31).

The rear adjusting panels (33) are mounted movably on the top surface of the baseplate (31) near the rear end and each rear adjusting panel (33) has a rear end, a bottom, a rear retaining board (331), two rear mounting bolts (332), a second spring (333) and two rear guiding rods (334). The rear retaining board (331) is formed on and protrudes from the rear end of the rear adjusting panel (33) to abut the heel of a user. The rear mounting bolts (332) are mounted in the rear adjusting panel (33), extend through the baseplate (31) and are respectively extended into the third and fourth guiding holes (103, 104) of the body (10). The second spring (333) is connected to the rear adjusting panels (33) between two rear mounting bolts (332). The rear guiding rods (334) are formed on and protrude from the bottom of the rear adjusting panel (33), extend through the rear guiding hole (312) and are respectively extended in the third and fourth guiding holes (103, 104) of the body (10) to make the rear adjusting panel (33) moving smoothly relative to the baseplate (31).

Figure 4:
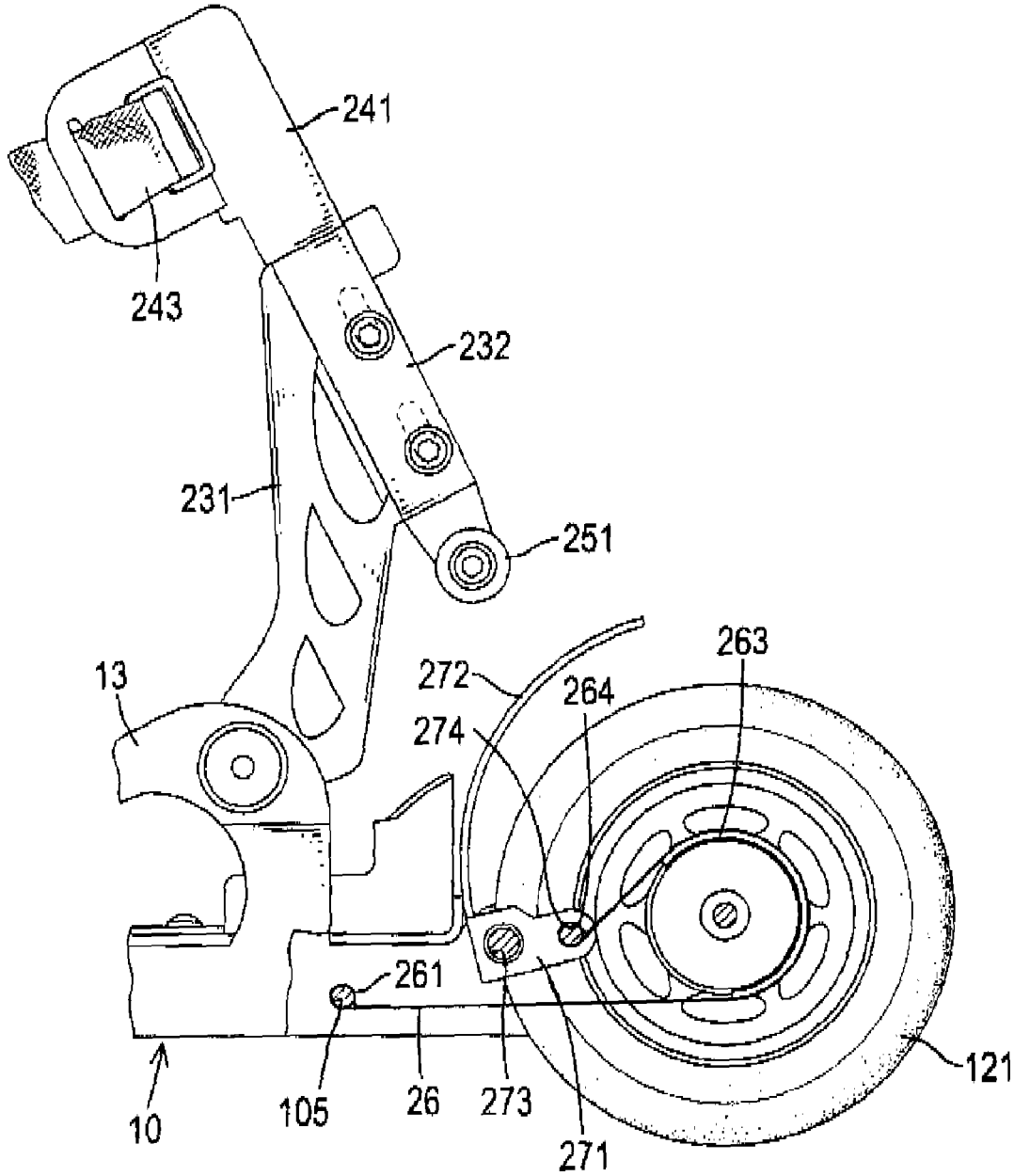
FIG. 4 is an enlarged side view in partial section of the roller skate in FIG. 1
Figure 5:
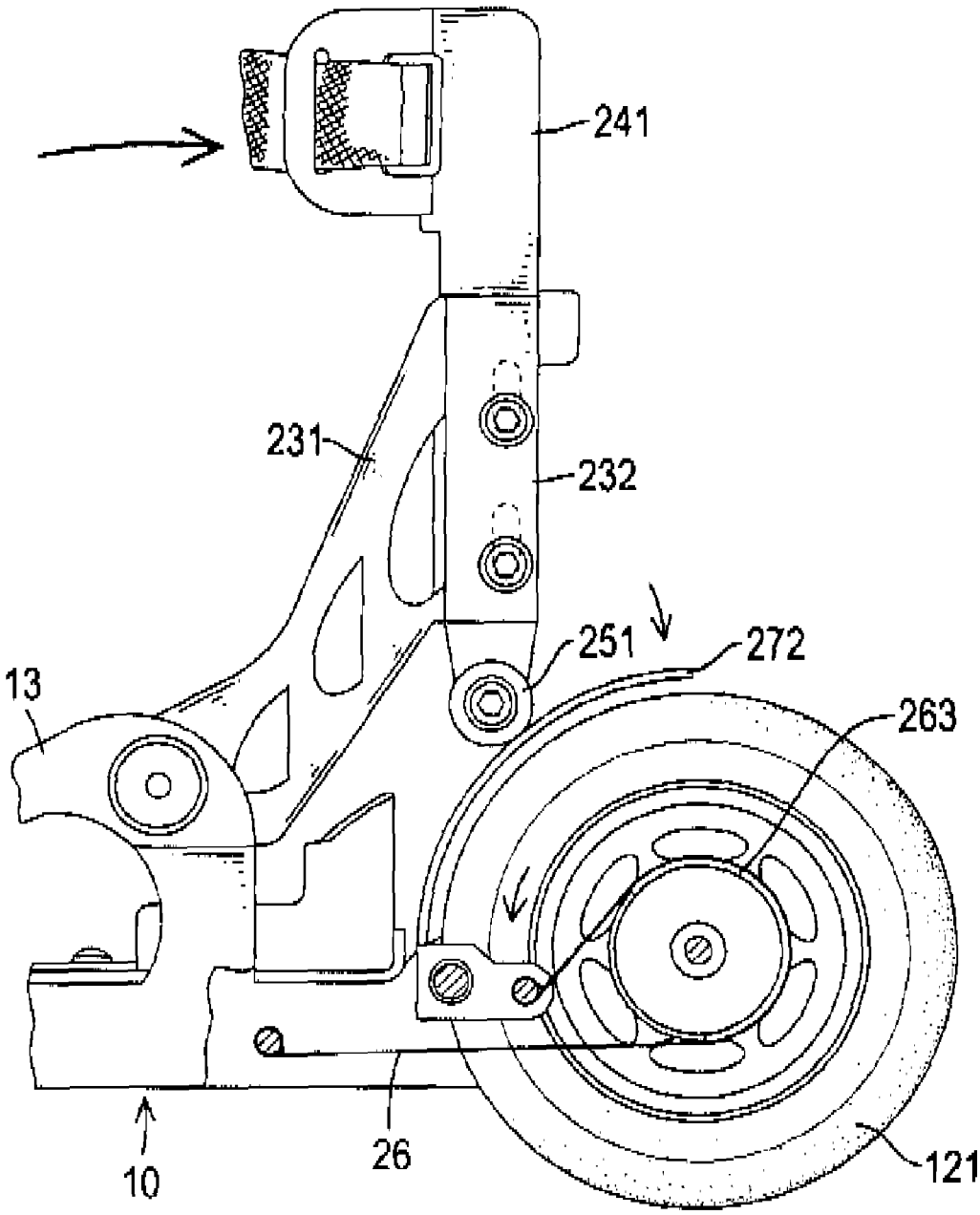
FIG. 5 is an enlarged operational side view in partial section of the roller skate in FIG. 1.

With reference to FIGS. 4 and 5, when a user wants to stop or slow down the roller skate, he or she only leans his/her leg backward relative to the body (10) to pivot the operating device (21) of the brake (20) relative to the holding frame (13) and close to the braking device (22). Then, the pressing axle (251) of the pressing arm (25) will press against the abutting panel (272) to pivot the abutting frame (27) relative to the rear bracket (12). When the abutting frame (27) is pivoted relative to the rear bracket (12), the clamping panels (262) of the clamping frame (26) are curved toward the rear roller (121) and the brake pads (263) on the internal surfaces of the clamping panels (262) rubs against the annular grooves (122) to slow down or stop the rotation of the rear roller (121).

Figure 6:
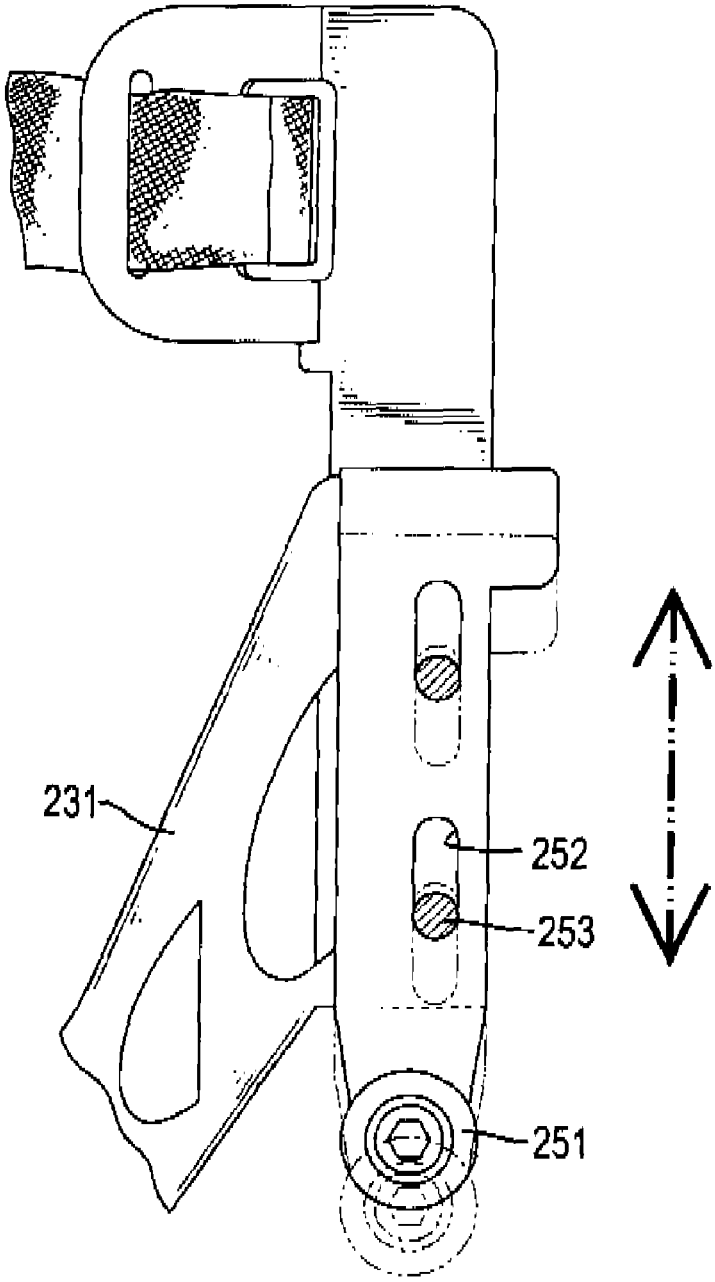
FIG. 6 is another enlarged operational side view in partial section of the roller skate in FIG. 1.

With reference to FIG. 6, the pressing arm (25) can be adjusted upward or downward relative to the abutting panel (272) of the abutting frame (27) after the fasteners (253) being released and moved along the elongated holes (252) of the pressing arm (25).

With further reference to FIGS. 7 and 8, the front retaining panel (32) and the rear retaining panels (33) can be moved smoothly relative to the baseplate (31) in two different directions to fit the sole of the user with the sole adjusting device (30). When the retaining boards (321, 331) being pushed, the mounting bolts (322, 332) can move relative to the guiding holes (101, 102, 103, 104) and the sole of the user can be held securely by the adjusting panels (32, 33) with the resilient force provided by the springs (324, 333).

The roller skate in accordance with the present invention as described has the following advantages.

1. The roller skate can be slowed down and stopped smoothly by means of the clamping force provided by the abutting frame (27) pressing the clamping panels (262) to move relative to the rear roller (121) to make the brake pads (263) rubbing against the annular grooves (122) of the rear roller (121) and this can prevent the user from falling down and getting hurt as the brake pad (534) of the conventional roller skate rubbing directly against the rear roller (52).

2. The brake pads (263) on the internal surfaces of the clamping panels (262) are not rubbed directly against the rear roller (121) and rubbed against the annular grooves (122) of the rear roller (121), the external surfaces of the annular grooves (122) is more smooth than the external surface of the rear roller (121) and this can keep the brake pads (263) from wearing down from the rear roller (121). Then a useful life of the brake pads (263) of the clamping frame (26) can be prolonged.

3. The pressing arm (25) can be adjusted upward or downward relative to the abutting panel (272) to fit with different needs.

4. The roller skate can be adjusted in length to fit the sole of the user with the sole adjusting device (30) conveniently by pushing the retaining boards (321, 331) to move relative to baseplate (31) and the body (10).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A roller skate having
- a body having
  - a front end;
  - a rear end;
  - two side edges;
  - a top surface;
  - a bottom surface;
  - a front bracket being mounted on the front end of the body and having
    - a front end; and
    - a front roller being mounted rotatably in the front end of the front bracket;
  - a rear bracket being mounted on the rear end of the body and having
    - a rear end;
    - a rear roller being mounted rotatably in the rear end of the rear bracket and having
      - two sidewalls;
      - an external surface; and
      - two annular grooves being respectively formed around the sidewalls of the rear roller; and
  - two holding frames being formed with the side edges of the body between the front and rear brackets and each having a rear end;
- a brake being connected to the body and having
  - an operating device being connected pivotally to the body and having
    - a mounting frame being connected pivotally to the holding frames of the body;
    - a connecting frame being connected detachably to the mounting frame; and
    - a pressing ant being connected to the connecting frame; and
  - a braking device being connected to the rear bracket of the body below the pressing arm of the operating device and having
    - a clamping frame being connected to the body between the rear bracket and the rear roller and having
      - a front end;
      - a rear end;
      - two clamping panels being defined in the rear end of the clamping frame and being curved around the annular grooves of the rear roller and each clamping panel having
        - an internal surface; and
        - a free end; and
      - two brake pads being respectively mounted on the internal surfaces of the clamping panels around the annular grooves of the rear roller; and
    - an abutting frame being connected to the rear bracket of the body above the clamping frame and having
      - a bottom end;
      - a linking mount being defined in the bottom end of the abutting frame and being pivotally connected to the rear bracket and the clamping frame; and
      - an abutting panel being formed with the linking frame, being bent backward above the rear roller of the rear bracket and having an internal surface facing to the external surface of the rear roller; and
- a sole adjusting device being connected to the body and having
  - a baseplate being mounted securely on the top surface of the body and having a top surface;
a front end; and
a rear end;

a front adjusting panel being mounted movably on the top surface of the baseplate near the front end of the baseplate; and two rear adjusting panels being mounted movably on the top surface of the baseplate near the rear end of the baseplate.

2. The roller skate as claimed in claim 1, wherein the body further has two mounting holes being formed through the body near the rear bracket; and the clamping frame further has a mounting shaft being transversally formed on the front end of the clamping frame and being mounted in the mounting holes of the body.

3. The roller skate as claimed in claim 2, wherein the rear bracket further has two connecting holes being formed transversally through the rear bracket near the rear end of the body;

the clamping frame further has two connecting rods being respectively formed on the free ends of the clamping panels; and the abutting frame further has two linking holes being formed through the linking mount and aligning with the connecting holes of the rear bracket; and two rod holes being formed through the linking mount and being respectively mounted around the connecting rods to hold the clamping frame with the abutting frame.

4. The roller skate as claimed in claim 3, wherein the mounting frame further has two extending arms being respectively connected pivotally to the rear ends of the holding frames and each extending arm having a lower end being connected pivotally to the rear end of one of the holding frames;

an upper end;

a mounting tab being formed on the upper end of the extending arm above the rear roller of the rear bracket and parallel to the mounting tab on the other extending arm; and multiple through holes being formed through the mounting tab;

the connecting frame further has two connecting beams being connected to the mounting frame between the mounting tabs and each connecting beam having a top end;

multiple circular holes being formed through the connecting beam and aligning with the through holes in a corresponding one of the mounting tabs; and a leg belt being connected to the top end of the connecting beam to hold a leg of a user; and the pressing arm is connected to the connecting frame between the connecting beams and further has a bottom end;

a pressing axle being transversally formed on the bottom of the pressing element above the rear roller of the rear bracket;

multiple elongated holes being formed through the pressing arm and aligning with the through holes of the mounting frame and the circular holes of the connecting frame; and multiple fasteners being extended through the through holes, the circular holes and the elongated holes to connect the pressing arm with the connecting frame and the mounting frame.

5. The roller skate as claimed in claim 4, wherein the body further has multiple guiding holes being formed through the top surface of the body between the brackets and the holding frame and including a first guiding hole, a second guiding bole, a third guiding hole and a fourth guiding hole from the front end to the rear end of the body; and The baseplate is mounted securely on the top surface of the body over the guiding holes and further has a front guiding slot being formed longitudinally through the baseplate near the front end and communicating with the first guiding hole of the body; and a rear guiding hole being formed transversally through the baseplate near the rear end and communicating with the third guiding hole and the fourth guiding hole of the body.

6. The roller skate as claimed in claim 5, wherein the front adjusting panel further has a front end;

a front retaining board being formed on and protruding from the front end of the front adjusting panel;

a front mounting bolt being mounted securely in the front adjusting panel near the front retaining board and extending into the front guiding slot of the baseplate and the first guiding hole of the body;

a mounting post being mounted securely on the bottom surface of the body between the second and third guiding holes; and a first spring being connected to the front mounting bolt and the mounting post below the body.

7. The roller skate as claimed in claim 6, wherein the front adjusting panel further has two front guideways being formed through the front adjusting panel and parallel to the front guiding slot of the baseplate; and two front guiding rods being mounted on the top surface of the body between the first and second guiding holes and being respectively extended into the front guideways of the front adjusting panel.

8. The roller skate as claimed in claim 7, wherein each rear adjusting panel further has a rear end;

a bottom;

a rear retaining board being formed on and protruding from the rear end of the rear adjusting panel;

two rear mounting bolts being mounted in the rear adjusting panel and being respectively extended into the third and fourth guiding holes of the body; and a second spring being connected to one of the mounting bolts of the rear adjusting panel and one of the mounting bolts of the other rear adjusting panel.

9. The roller skate as claimed in claim 8, wherein each rear adjusting panel further has two rear guiding rods being formed on and protruding from the bottom of the rear adjusting panel and being respectively extended into the third and fourth guiding holes of the body.

10. The roller skate as claimed in claim 9, wherein each holding frame further has multiple sole belts being connected to the holding frame.

11. The roller skate as claimed in claim 10, wherein the front bracket is U-shaped;

the rear bracket is U-shaped;

each holding frame is triangular; and the linking mount is U-shaped.

* * * * *